United States Patent [19]

Pampell

[11] 4,291,764

[45] Sep. 29, 1981

[54] WELL CASING SCRAPING APPARATUS

[75] Inventor: Davy G. Pampell, Houston, Tex.

[73] Assignee: Baker International Corporation, Orange, Calif.

[21] Appl. No.: 110,078

[22] Filed: Jan. 7, 1980

[51] Int. Cl.[3] ..... E21B 37/02

[52] U.S. Cl. ..... 166/173

[58] Field of Search ..... 166/171-175; 175/272, 291

[56] References Cited

U.S. PATENT DOCUMENTS

| | | | |
|---|---|---|---|
| 2,464,390 | 3/1949 | Hammer | 166/173 |
| 3,032,114 | 5/1962 | Best | 166/173 |
| 3,251,418 | 5/1966 | Condra | 166/173 |
| 3,757,859 | 9/1973 | Hammon et al. | 166/173 |
| 4,189,000 | 2/1980 | Best | 166/173 |

*Primary Examiner*—James A. Leppink

*Attorney, Agent, or Firm*—William C. Norvell, Jr.

[57] ABSTRACT

A well casing scraping apparatus includes a generally cylindrical mandrel connected to a power driven rotatable work string or conduit. At least one peripheral ramp surface is formed on the mandrel and an annular scraping means is formed by the assembly of a plurality of externally toothed arcuate segments around the ramp surface portion of the tool support, with each segment having an internal arcuate ramp surface conforming to the adjacent portion of the mandrel ramp surface. Retaining sleeves are provided for the tool segments which not only retain the segments against radial outward movement but confine the segments axially to engagement with a particular portion of the ramp surfaces, whereby the effective working diameter of the segmented scraping means may be effectively controlled by changing the axial position of the retaining sleeves.

13 Claims, 5 Drawing Figures

WELL CASING SCRAPING APPARATUS

BACKGROUND OF THE INVENTION

1. Field of the Invention

This invention relates to an apparatus for scraping the inside diameters of well casings.

2. Description of the Prior Art

In the drilling completion or workover of an oil well, the interior of the well casing or other conduit, is exposed to a variety of materials which tend to adhere to the internal surface of the conduit, such as drilling mud, cements, rust and scale. To permit the unimpeded passage of pumping equipment, perforating equipment and the like into and out of the well casing, it is obviously desirable that all foreign substances adhering to the interior walls of the casing first be removed. Additionally, burrs resulting from perforation operations prohibit the free passage of packing and other elements through the well, and such burrs of necessity must therefore be removed.

To effect such removal, a number of scraping tools have heretofore been proposed. Such prior art scrapers have been characterized in having only a limited effective diametrical range of operation. For example, it is known that a seven inch exterior diameter well casing may have five or more different internal diameters, dependent on the casing weight required for the particular installation. As a result, the scraping apparatus heretofore available required the installation of at least three different sizes of blade blocks, one at a time, on the tool support in order to scrape the full range of internal diameters provided in seven inch casing. Furthermore, prior art scraping mechanisms were not susceptible to ready adjustment of the effective working diameter of the scraping tools, requiring that the tool be practically disassembled in order to achieve any adjustment.

Similarily, prior art scraping apparatuses did not incorporate any means for compensating for wear on the blade blocks, requiring the replacement of the entire blade block assembly whenever any significant wear was achieved. Additionally, the mounting of blade blocks on conventional apparatus was such that if a jam occurred between the teeth of the blade block and an obstruction in the casing, it was generally quite difficult to pull the tool free.

It is therefore apparent that there is a distinct need for an improved, more flexible, readily adjustable scraping apparatus for well casings.

SUMMARY OF THE INVENTION

The invention provides a well casing scraping apparatus embodying a generally cylindrical mandrel which is threaded at the top end thereof for connection to a power driven rotatable work string to permit the mandrel to be lowered into a well and rotated at any desired location. The mandrel is provided on its external periphery with a pair of axially spaced, peripherally extending ramp surfaces. The scraper means are formed by the assembly of a plurality of annular segments around each ramp surface portion of the mandrel. Each annular segment is provided with helically disposed scraping teeth on its outer periphery and an internal arcuate ramp surface corresponding to the adjacent portion of the peripheral ramp surface of the mandrel. Springs are mounted between the internal ramp surfaces of the tool carrying segments and the external ramp surfaces of the mandrel to normally urge each tool carrying segment radially outwardly. A plurality of retaining sleeves are provided on the mandrel to oppose the radially outward movements of the tool carrying segments and hold the segments in annular assembly on the mandrel. Additionally, the retaining sleeves are mounted for convenient axial adjustment by an adjusting sleeve which is threadably secured to the periphery of the mandrel, and imposes an axial restraint on the retaining sleeves, thus permitting convenient adjustment of the relative positions of the respective ramp surfaces of the mandrel and the tool segments that are in engagement therewith, thus adjusting the effective minimum working diameter of the scraping means.

The effective minimum working diameter of the scraping means embodying this invention may thus be conveniently adjusted in the field by the simple turning movement of the adjusting sleeve. Moreover, by incorporating an axial spring pressure on the retaining sleeves to hold them in a desired axial position with respect to the adjusting sleeve, the retaining sleeves may be effectively moved axially relative to the tool carrying segments in the event that one or more of the segments becomes jammed in the casing. Such movement, which can be accomplished by the work string, effects the radially inward collapsing of all of the tool segments and hence the ready release of the jammed tool from the particular obstruction in the casing. It should be noted that the blade blocks are automatically reset by biasing means and the tool can continue to be run in the hole within another diameter conduit.

DESCRIPTION OF THE PREFERRED EMBODIMENTS

Figure 1:
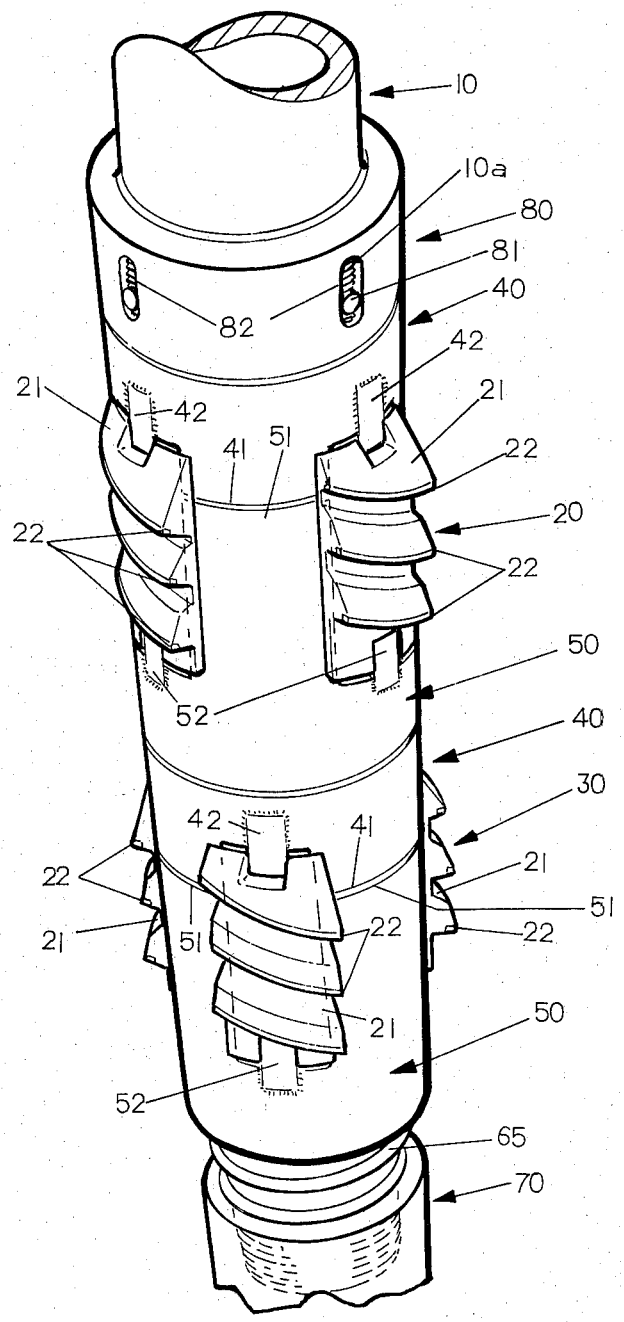
FIG. 1 is a schematic perspective view of an oil well casing scraping apparatus embodying this invention.

Referring particularly to FIG. 1, it will be observed that the scraping apparatus embodying this invention comprises an assemblage of a generally cylindrical tubular housing or mandrel 10, two axially spaced sets of identical annular segmented scraping tools 20 and 30, two upper retaining sleeves 40 respectively cooperating with the upper ends of the annular segmented scraping tools 20 and 30, two lower retaining sleeves 50 respectively cooperating with the lower ends of the annular segmented scraping tools 20 and 30, a spring 65 operating between a coupling sleeve 70 and the adjacent end of the lowermost retaining sleeve 50 to impose an axial bias on the entire assemblage, and an adjusting sleeve 80 threadably secured to an externally threaded portion **10*a* of the housing or mandrel 10 to permit adjustment of the axial position of the assemblage of cutting elements 20 and 30 relative to the mandrel 10**.

Figure 2:
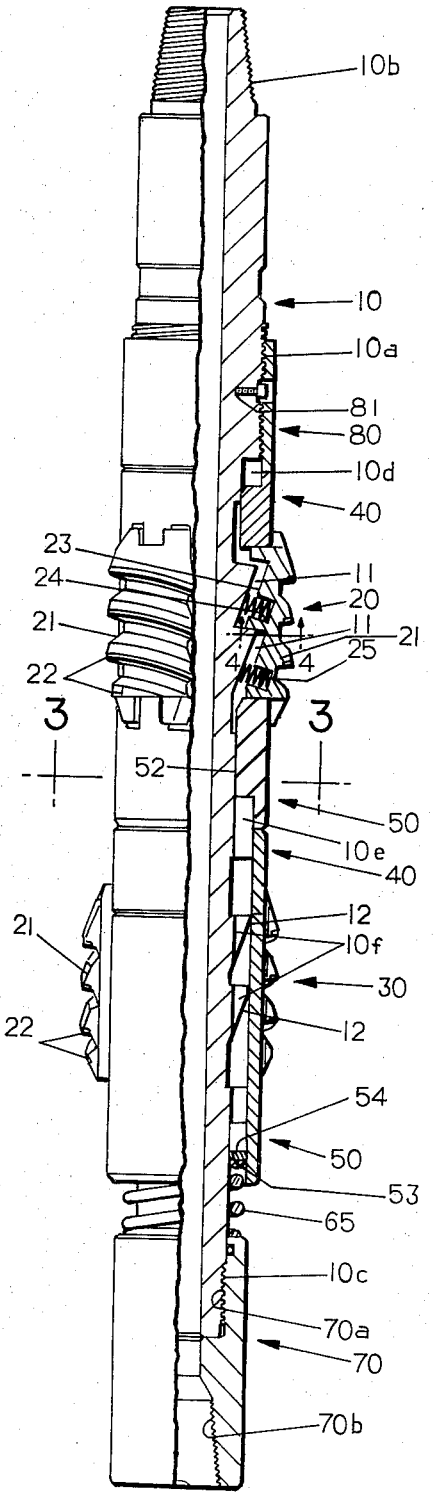
FIG. 2 is a vertical elevational view, partly in section, of the tool of FIG. 1.
Figure 3A:
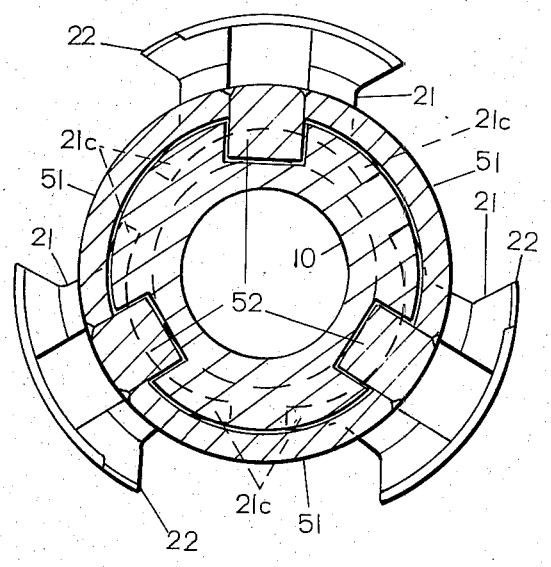
FIG. 3A is an enlarged scale sectional view taken on the plane 3—3 of FIG. 2 and illustrating the scraping blade elements in their outermost radial position.

Referring now to FIG. 2, the mandrel 10 comprises a hollow, generally cylindrical member having its top end provided with a tapered external thread **10*b* and its bottom end provided with a cylindrical threaded portion 10***c* which engages internal threads 70*a* provided in the coupling sleeve 70. The top end of the mandrel 10 may thus be connected to the end of a power driven, rotatable work string (not shown) by which the mandrel may be lowered into the well to effect the scraping operation. If it is desired that additional tools be carried below the mandrel 10, or additional scraping tools, the bottom end of coupling sleeve 70 is provided with internal tapered threads 70*b* to effect such connection.

On the medial portions of the mandrel 10, a pair of axially adjacent, peripherally extending upper ramp surfaces 11 are provided. A short distance below the upper pair of ramp surfaces 11, there are provided a pair of identical peripherally extending ramp surfaces 12.

Figure 4:
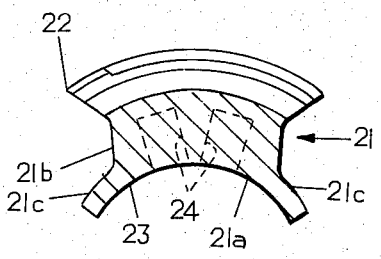
FIG. 4 is an enlarged scale, sectional view taken on the plane 4—4 of FIG. 2.

The upper annular segmented scraping tool 20 is shown as comprising an assemblage of three annular segments 21, (FIG. 4) each having a base portion 21*a* of 120° arcuate extent to define a complete annular structure when assembled on the mandrel 10. Each segment 21 is provided with a radial body portion 21*b* of more limited arcuate extent than base portion 21*a*, thus defining arcuate edge projections 21*c*. A plurality of helically disposed cutting edges or blades 22 are provided on the outer periphery of the body portion 21*b*. The internal surfaces of the segments 21 are provided with arcuate segmental ramp surfaces 23 (FIG. 2) which respectively cooperate with the peripheral ramp surfaces 11 or 12 provided on the mandrel 10 when the segments 21 are assembled around such ramp surfaces. Each scraping tool segment 21 is biased radially outwardly by four compression springs 25 respectively mounted in recesses 24 formed in the ramp surfaces 23 of the segments 21. The other end of springs 25 engage the peripheral ramp surfaces 11 or 12 of the mandrel 10.

The segments 21 are maintained in their annular relationship through the cooperation of upper retaining sleeve 40 and lower retaining sleeve 50 with the adjacent axial ends of the segments 21. Sleeve 40 is secured to the mandrel 10 for co-rotation by circumferentially spaced keys 42 welded thereto and respectively engaging key slots 10*d* provided in the mandrel 10. Similarly, the sleeve 50 is secured to the mandrel 10 by circumferentially spaced welded keys 52 engaging slots 10*e* in the mandrel 10. To facilitate assembly of sleeves 40 and 50 on the mandrel 10, slots 10*f* are provided in the major diameter portions where necessary to permit axial passage of keys 42 and 52.

Sleeve 40 is further provided with a plurality of peripherally spaced, axially extending projections 41 which respectively snugly surround the top portions of tool segment body portions 21*b* and overlie the arcuate projections 21*c* of segments 21. The lower retaining sleeve 50 is provided with a plurality of peripherally spaced, axially extending projections 51 to snugly surround the lower portions of tool body portions 21*b* and overlie arcuate projections 21*c* respectively of the segments 21.

Figure 3B:
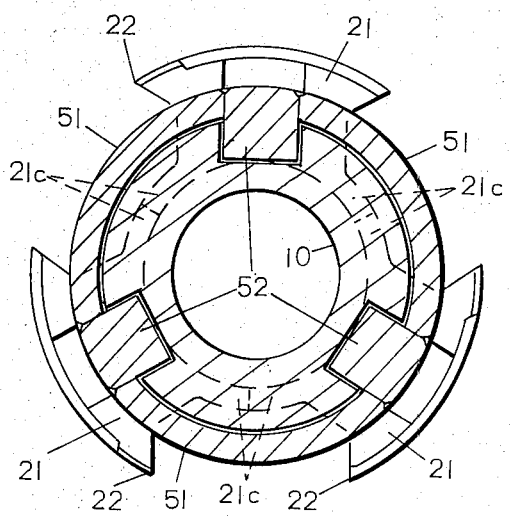
FIG. 3B is an enlarged scale sectional view taken on the plane 3—3 of FIG. 2 illustrating the scraping blade elements in their innermost radial position.

By virtue of these interengagements, the sleeves 40 and 50 retain the segments 21 of the annular segmented scraping tool 20 against both radial and axial movements, while permitting a limited degree of radial movement of the segments 21 under the bias of the springs 25. The minimum effective working diameter of the teeth 22 of the segments 21 is thereby determined when the springs 25 are fully compressed and the ramp surfaces 23 of the segments 21 are in abutting engagement with the peripherally extending ramp surfaces 11 on the mandrel 10 (FIG. 3B). This minimum working diameter will, however, be subject to variation due to variation in the axial position of the annular segmented scraping tool 20 relative to the mandrel 10 and such axial adjustment of the retaining sleeves will be hereinafter described: Additionally, sleeves 40 and 50 secure the segments 21 for co-rotation with the mandrel 10.

The lower annular segmented scraping tool 30 is identical to upper tool 20 and is mounted in surrounding relationship to the lower pair of peripherally extending ramp surfaces 12 in the same manner as heretofore described, but with the cutting teeth segments 21 displaced 60° to lie intermediate the upper cutting teeth segments. An upper sleeve 40 and a lower sleeve 50 cooperate with segments 21 of the lower segmented scraping tool 30 in the same manner as heretofore described.

Even though the mandrel 10 is keyed to each of the upper retaining sleeves 40 and each of the lower retaining sleeves 50, nevertheless, the key slots 10*d* and 10*e* provided in the mandrel 10 are of sufficient length to permit limited axial adjusting movement of the entire assemblage of scraping tools and retaining sleeves relative to the mandrel. The compression spring 65 mounted between the upper end of the coupling sleeve 70 and a washer 54 abutting a lower end face 53 of the lowermost retaining sleeve 50 imparts an upward axial bias to the assemblage relative to the mandrel 10. Hence the exact axial position of the assemblage is determined by the adjusting sleeve 80 which, as previously mentioned, is threadably secured to the threads 10*a* provided on the mandrel 10 and locked in any selected one of a plurality of axial positions by a bolt 81 which is insertable into the mandrel 10 thru any one of four axial slots 82 provided in adjusting sleeve 80.

Therefore, if it is desired to shift the axial position of the scraping tool segments 21 relative to the ramp surfaces 11 and 12, it is only necessary to remove the locking bolt 81 and adjust the position of sleeve 80 on threads 10*a* to effect either an upward or a downward shifting of the annular segmented scraping tools 20 and 30 relative to the mandrel 10. Such axial adjusting movement concurrently effects a change in the minimum effective cutting diameter of the teeth 22 of the annular segmented scraping tools 20 and 30. Thus, if the assemblage of scraping tools and retaining sleeves is moved downwardly relative to the mandrel 10, the minimum effective cutting diameter is reduced. Conversely, if the assemblage is moved upwardly, the minimum effective cutting diameter of the scraping tools is increased. It will therefore be apparent that adjustment of the effective cutting diameter to accommodate the use of the tool to scrape different interior sizes of casings may be readily accomplished without requiring the complete disassembly of the apparatus. For example, the illustrated construction can accommodate the full range of internal diameters experienced in all standard sizes of seven inch OD well casing. Any wear of the cutting teeth 22 is readily compensated by outward adjustment of the segments 21.

A further advantage of the described construction arises when the scraping teeth 22 of the annular segmented cutting tools 20 or 30 become jammed against an obstruction in the well, preventing further rotational movement and at the same time, any axial movement of the cutting tools relative to the well casing. When such jam occurs, it is only necessary to pull the mandrel 10 upwardly by the work string. This relative movement with respect to the jammed scraping tool permits the cutting tool segments to collapse inwardly to the minimum possible diameter and, in most cases, is effective to release the particular jammed cutting tool from its engagement with the obstruction.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A well casing scraping apparatus, comprising: a generally cylindrical mandrel having means on one end thereof for connection to a conduit; at least one peripheral ramp surface formed on said mandrel; annular scraping means defined by a plurality of arcuate segments around said ramp surface portion of said mandrel, each segment having scraping teeth on its outer periphery and an internal arcuate ramp surface conforming to the adjacent portion of said peripheral ramp surface, whereby the engagement of said internal and peripheral ramp surfaces determines the minimum effective scraping diameter of the scraping means, each of said arcuate segments including an arcuate base portion overlying an arcuate portion of said ramp surface and a radially projecting integral body portion carrying said scraping teeth, said body portion being of shorter arcuate extent than said base portion whereby the edges of said base portion project arcuately beyond said body portion; a retaining sleeve mounted on said mandrel adjacent said scraping means, means on said retaining sleeve surrounding portions of said scraping means and limiting both radial and axial movements of said segments relative to said mandrel including axial projections of arcuate cross-section extending between said segment body portions and overlying the arcuately projecting edges of said segment base portions; resilient means intermediate said mandrel and each said segment to bias the segments radially outwardly to the extent permitted by said retaining sleeve; and means for adjusting the axial position of said retaining sleeve relative to said mandrel, thereby adjusting the minimum effective scraping diameter of said scraping means.

2. A well casing scraping apparatus, comprising: a generally cylindrical mandrel having means on one end thereof for connection to a tubular conduit; at least one peripheral ramp surface formed on said mandrel; annular scraping means defined by a plurality of segments around said ramp surface portion of said mandrel, each segment having helically disposed scraping teeth on its outer periphery and an internal arcuate ramp surface conforming to the adjacent portion of said peripheral ramp surface, whereby the engagement of said internal and peripheral ramp surfaces determines the minimum effective scraping diameter of the scraping means, each of said arcuate tool segments including an arcuate base portion overlying an arcuate portion of said ramp surface and a radially projecting integral body portion carrying said scraping teeth, said body portion being of shorter arcuate extent than said base portion whereby the edges of said base portion project arcuately beyond said body portion; a pair of retaining sleeves mounted on said mandrel respectively adjacent the ends of said scraping means; means on each retaining sleeve surrounding portions of the respective adjacent end of said scraping means and limiting both radial and axial movements of said segments relative to said mandrel including axial projections of arcuate cross-section extending between said segment body portion and overlying the arcuately projecting edges of said segment base portions; resilient means intermediate said mandrel and each said segment to bias the segments radially outwardly to the extent permitted by said retaining sleeves; and means for adjusting the axial position of said retaining sleeves relative to said mandrel, thereby adjusting the minimum effective scraping diameter of the scraping means.

3. A well casing scraping apparatus, comprising: a generally cylindrical mandrel having means on one end thereof for connection to a conduit; a pair of axially spaced, peripherally extending ramp surfaces formed on said mandrel; a pair of annular scraping means defined by a plurality of annular segments respectively around each said ramp surface portion of said mandrel, each annular segment having scraping teeth on its outer periphery and an internal arcuate ramp surface conforming to the adjacent portion of said peripheral ramp surface on the mandrel, whereby the engagement of said internal and peripheral ramp surfaces determines the minimum effective scraping diameter of the scraping means, each of said arcuate tool segments including an arcuate base portion overlying an arcuate portion of said ramp surface and a radially projecting integral body portion carrying said scraping teeth, said body portion being of shorter arcuate extent than said base portion whereby the edges of said base portion project arcuately beyond said body portion, each scraping means having its scraping teeth disposed in angularly spaced clusters, the clusters of one said scraping means being angularly intermediate the clusters of the other said scraping means; retaining sleeves mounted on said mandrel respectively adjacent the axial ends of said annular scraping means; means on each retaining sleeve surrounding the respective adjacent end of said annular scraping means and limiting both radial and axial movements of said segments relative to said mandrel including axial projections of arcuate cross-section extending between said segment body portions and overlying the arcuately projecting edges of said segment base portions; resilient means intermediate said tool support and each said annular segment to bias the segments radially outwardly to the extent permitted by said retaining sleeves; and means for adjusting the axial position of said retaining sleeves relative to said mandrel, thereby adjusting the minimum effective scraping diameter of the scraping means.

4. The apparatus defined in claim 1, 2 or 3 wherein each retaining sleeve is secured by a key to said mandrel for co-rotation and imparts rotation to said scraping means.

5. A well casing scraping apparatus, comprising: a generally cylindrical mandrel having means on one end thereof for connection to a conduit; at least one peripheral ramp surface formed on said mandrel; annular scraping means defined by a plurality of arcuate segments around said ramp surface portion of said mandrel, each segment having scraping teeth in its outer periphery and an internal arcuate ramp surface conforming to the adjacent portion of said peripheral ramp surface, whereby the engagement of said internal and peripheral ramp surfaces determines the minimum effective scraping diameter of the scraping means; a retaining sleeve mounted on said mandrel adjacent said scraping means, said retaining sleeve being secured by a key to said mandrel for co-rotation and imparting rotation to said scraping means, means on said retaining sleeve surrounding portions of said scraping means and limiting both radial and axial movements of said segments relative to said mandrel; resilient means intermediate said mandrel and each said segment to bias the segments radially outwardly to the extent permitted by said retaining sleeve; and means for adjusting the axial position of said retaining sleeve relative to said mandrel, thereby adjusting the minimum effective scraping diameter of said scraping means.

6. The apparatus defined in claim 5 wherein each of said arcuate segments comprises: an arcuate base portion overlying an arcuate portion of said ramp surface; and a radially projecting integral body portion carrying said scraping teeth, said body portion being of shorter arcuate extent than said base portion whereby the edges of said base portion project arcuately beyond said body portion, and said means on said retaining sleeve comprises axial projections of arcuate cross-section extending between said segment body portions and overlying the arcuately projecting edges of said segment base portions.

7. The apparatus defined in claim 1 or 5 wherein said axial position adjustment means comprises a spring urging said scraping means axially relative to said mandrel, and an internally threaded sleeve threadably secured to said mandrel to limit the spring pressed axial movement of said scraping means, thereby permitting adjustment of the axial position of said scraping means relative to said peripheral ramp.

8. A well casing scraping apparatus, comprising: a generally cylindrical mandrel having means on one end thereof for connection to a tubular conduit; at least one peripheral ramp surface formed on said mandrel; annular scraping means defined by a plurality of segments around said ramp surface portion of said mandrel, each segment having helically disposed scraping teeth on its outer periphery and an internal arcuate ramp surface conforming to the adjacent portion of said peripheral ramp surface, whereby the engagement of said internal and peripheral ramp surfaces determines the minimum effective scraping diameter of the scraping means; a pair of retaining sleeves mounted on said mandrel respectively adjacent the ends of said scraping means, each said retaining sleeve being secured by a key to said mandrel for co-rotation and imparting rotation to said securing means; means on each retaining sleeve surrounding portions of the respective adjacent end of said scraping means and limiting both radial and axial movements of said segments relative to said mandrel; resilient means intermediate said mandrel and each said segment to bias the segments radially outwardly to the extent permitted by said retaining sleeves; and means for adjusting the axial position of said retaining sleeves relative to said mandrel, thereby adjusting the minimum effective scraping diameter of the scraping means.

9. The apparatus defined in claim 8 wherein each of said arcuate tool segments comprises an arcuate base portion overlying an arcuate portion of said ramp surface, and a radially projecting integral body portion carrying said scraping teeth, said body portion being of shorter arcuate extent than said base portion whereby the edges of said base portion project arcuately beyond said body portion and said means on said retaining sleeves comprise axial projections of arcuate cross-section extending between said segment body portion and overlying the arcuately projecting edges of said segment base portions.

10. The apparatus defined in claim 2 or 8 wherein said adjusting means comprises a spring urging said sleeves and said annular scraping means axially relative to said mandrel and an internally threaded sleeve threadably secured to said mandrel to limit the spring pressed axial movement of said annular scraping means.

11. A well casing scraping apparatus, comprising: a generally cylindrical mandrel having means on one end thereof for connection to a conduit; a pair of axially spaced, peripherally extending ramp surfaces formed on said mandrel; a pair of annular scraping means defined by a plurality of annular segments respectively around each said ramp surface portion of said mandrel, each annular segment having scraping teeth on its outer periphery and an internal arcuate ramp surface conforming to the adjacent portion of said peripheral ramp surface on the mandrel, whereby the engagement of said internal and peripheral ramp surfaces determines the minimum effective scraping diameter of the scraping means, each scraping means having its scraping teeth disposed in angularly spaced clusters, the clusters of one said scraping means being angularly intermediate the clusters of the other said scraping means; retaining sleeves mounted on said mandrel respectively adjacent the axial ends of said annular scraping means, each said retaining sleeve being secured by a key to said mandrel for co-rotation and imparting rotation to said scraping means; means on each retaining sleeve surrounding the respective adjacent end of said annular scraping means and limiting both radial and axial movements of said segments relative to said mandrel; resilient means intermediate said tool support and each said annular segment to bias the segments radially outwardly to the extent permitted by said retaining sleeves; and means for adjusting the axial position of said retaining sleeves relative to said mandrel, thereby adjusting the minimum effective scraping diameter of the scraping means.

12. The apparatus defined in claim 11 wherein each of said arcuate tool segments comprises an arcuate base portion overlying an arcuate portion of said ramp surface, and a radially projecting integral body portion carrying said scraping teeth, said body portion being of shorter arcuate extent than said base portion whereby the edges of said base portion project arcuately beyond said body portion, and said means on said retaining sleeves comprises axial projections of arcuate cross-section extending between said segment body portions and overlying the arcuately projecting edges of said segment base portions.

13. The apparatus defined in claim 3 or 11 wherein said adjusting means comprises a spring urging said sleeves and said annular segmented scraping tools axially relative to said mandrel, and an internally threaded sleeve threadably secured to said mandrel to limit the spring pressed axial movement of said annular segmented scraping means.

* * * * *